United States Patent [19]

Bloch

[11] Patent Number: 4,853,014

[45] Date of Patent: Aug. 1, 1989

[54] METHOD AND APPARATUS FOR CLEANING CONDUITS

[75] Inventor: Christopher J. Bloch, Kingwood, Tex.

[73] Assignee: Naylor Industrial Services, Inc., Pasadena, Tex.

[21] Appl. No.: 78,127

[22] Filed: Jul. 27, 1987

[51] Int. Cl.[4] ..... B01D 19/00

[52] U.S. Cl. ..... 55/185; 55/204; 55/207; 55/235; 55/237; 261/DIG. 76

[58] Field of Search ..... 55/185, 186, 193, 204, 55/207, 235, 237; 134/22.12, 22.15, 22.18, 30, 31, 104, 109–111, 166 C, 167 C, 171; 261/16, 116, DIG. 76

[56] References Cited

U.S. PATENT DOCUMENTS

| | | | |
|---|---|---|---|
| 580,169 | 4/1897 | Washington | 55/193 |
| 1,792,590 | 2/1931 | Kirk | 55/237 X |
| 1,969,888 | 8/1934 | Gibson | 55/193 X |
| 2,315,226 | 3/1943 | Rohlin | 55/235 X |
| 2,604,185 | 7/1952 | Johnstone et al. | 55/237 X |
| 2,848,197 | 8/1958 | Evans, Jr. et al. | 55/193 X |
| 2,935,375 | 5/1960 | Boucher | 55/237 X |
| 3,084,076 | 4/1963 | Loucks et al. | 134/22 |
| 3,193,991 | 7/1965 | Browning et al. | 55/185 |
| 3,212,235 | 10/1965 | Markant | 55/204 X |
| 3,367,402 | 2/1968 | Cross, Jr. et al. | 55/186 X |
| 3,409,470 | 11/1968 | Karpovich | 134/22.12 X |
| 3,494,107 | 2/1970 | Sackett, Sr. | 55/237 X |
| 3,894,851 | 7/1975 | Gorman | 261/16 X |
| 3,912,469 | 10/1975 | Ewan et al. | 261/DIG. 76 |
| 4,141,701 | 2/1979 | Ewan et al. | 261/DIG. 76 |
| 4,187,087 | 2/1980 | Whitescarver | 55/204 X |
| 4,684,442 | 8/1987 | Meredith et al. | 55/204 X |

FOREIGN PATENT DOCUMENTS

| | | | |
|---|---|---|---|
| 670150 | 9/1963 | Canada | 55/235 |
| 66335 | 6/1956 | France | 55/235 |
| 956076 | 9/1982 | U.S.S.R. | 134/22.12 |
| 899012 | 6/1962 | United Kingdom | 55/237 |

OTHER PUBLICATIONS

General Electric, "Instructions, Cleaning of Main Steam Piping and Provision for Hydrostatic Testing of Reheater", Entire Text 1983.

Brian E. Hopkinson & Omar Bravo, "Refinery Chemical Cleaning, Solution and Vapor Phase", Apr. 2, 1984, Entire Article.

Dowel Schlumberger, "Pre-Operational Cleaning of Refinery and Petrochemical Plants", Entire Text, 1977.

Chris Bloch, Mission Industrial Supply, "Enhanced Steam Blows", Entire Text, 1981.

Chris Bloch, Dow Industrial Services, "D.I.S. Introductory Engineering Handbook", 1974 Edition, Entire Text.

The Engineering Dept. of Crain Co., "Flow of Fluids through Valves Fitting and Pipe", (Technical Paper No. 410), 1957–1986, Entire Text.

Govier and Aziz, "The Flow of Complex Mixtures in Pipes", 1972, pp. 416–452 and 589–616.

Claude B. Nolte, "Optimum Pipe Size Selection", 1979 pp. 47–67.

Norman B. Miller and John W. Siegmond, "Chemical Cleaning Practices Used for Controlling Solid Particle Erosion of Steam Turbines", About 1985, pp. 3–29 to 3–47.

C. E. Fox, "Many Traditional Chemical Cleaning Problems Elliminated by New Chemicals and New Techniques", May, 1964, p. 3.

Vern Duckett, "Main Steam Line Blowdown Rust Inter-Office Correspondence", Feb. 17, 1984, Entire Document.

Anthony W. Montana, "A Results Report", Nov. 6, 1984, Entire Work.

(List continued on next page.)

*Primary Examiner*—Robert Spitzer

*Attorney, Agent, or Firm*—Gunn, Lee & Jackson

[57] ABSTRACT

An apparatus and method for steam cleaning of conduit or exhausting of high velocity steam with minimum noise levels in which high velocity steam is expanded with the simultaneous introduction of a decelerating fluid such as water in the form of a fine dispersion.

17 Claims, 4 Drawing Sheets

OTHER PUBLICATIONS

Edwin J. Brailey, Jr. "A Review of Exfoliation Chemical Cleaning Experience in the New England Electric System", 1985, pp. 3-49 to 3-60.

W. E. Stevens and John Gatewood, "Practices for Chemical Cleaning of Steam Cycle Pendant Loops and Steam Leads", 1985, pp. 3-61 to 3-73.

Unknown Employee of Combustion Engineering, "Combustion Engineering Resource Recovery Systems", Project initiation on Jul. 13, 1987, Entire Document.

Letter of Century Contractors West, Inc., Subject-"-Steam Blow", Jan. 22, 1987, Entire Document.

Unknown Employee of Hatachi, Ltd., "Hatachi, Ltd.-Steam Blowing Procedure of Gland Steam Pipe", Not Dated, Entire Document.

G. Wolch, Letter and attachments of Baltimore Resco Refuse Energy Systems Company entitled "Main Steam Lines Blowing Procedure", Aug. 23, 1984, Entire Document.

Joseph G. Singer, "Combustion-Fossil Power Systems", Third Edition 1981, pp. 10-20 to 20-23.

METHOD AND APPARATUS FOR CLEANING CONDUITS

BACKGROUND OF THE INVENTION

1. Field of the Invention

The present invention relates to the interior cleaning of pipes, conduit and the like. More particularly, the present invention relates to removal of scale and other solid deposits from the inside surfaces of pipes, conduits and the like by means of a high velocity gas stream.

2. Description of the Background

The interior walls or surfaces of pipes used in commercial installations, such as chemical plants, refineries, power generating plants, etc., are frequently coated with or have deposits of solid materials which have been deposited on the walls from the fluids passing through the pipes or have been left on the walls during manufacture of the pipe. These solid deposits on the interior of piping walls can lead to serious problems. Such deposits can interfere with desired flow patterns in the piping. Additionally, since the deposits may periodically dislodge into the flowing fluid, they can cause damage to or interfere with downstream equipment or processes. For example, steam used to drive a steam turbine must be free from debris entrained in the steam. Debris such as scale, slag or the like which may become dislodged from steam lines used to feed steam turbines can be accelerated to high velocities by the steam and at such velocities impinge on the turbine blade surfaces with sufficient force to damage the blades or other related equipment. Likewise, steam lines which supply steam to finely machined valves used for reducing or relieving excess pressure must be free of scale and debris which can cause serious damage to the valve internals if it becomes entrained in the flowing steam. Steam lines which convey steam to reactors or other process vessels must also be free of wall deposits and contaminates which can become entrained in the steam and possibly interfere with the process reactions.

In a typical prior art method of cleaning steam lines, it is customary to go through a cycle of heating, cooling and steam blowing. Thus, pressure is built up in the boiler and then released through the steam lines to be cleaned. The lines are then allowed to cool while steam pressure is built up again in the boiler. The cycle of heating, cooling and blowing is repeated until the steam emerging from the blow down piping is observed to be clean. In determining if the steam is clean, it is normal practice to blow the line with steam until a piece of metal, called a target, supported across the exhausting flow of steam shows no indication of debris impingement on its exposed surfaces. Typically, the number of such targets used may range from five to several hundred before a clean target is obtained indicating that the lines are free of loose debris or scale. This prior art method of steam cleaning piping is described in a publication of the General Electric Company entitled "Instructions-Cleaning of Main Steam Piping and Provisions for Hydrostatic Testing of Reheater," incorporated herein by reference.

It is also known, as taught in U.S. Pat. No. 3,084,076 to use chemical cleaning in which certain solvents or additives are added to the steam to dissolve scale, residue and other deposits from the lines being cleaned.

In another prior art method for steam line blowing or cleaning, air and water are simultaneously added to the flowing steam in the pipe to be cleaned to generate an annular mist of condensate droplets to penetrate laminar flow conditions at the pipe wall and thereby help to loosen debris from the pipe wall. In this prior art technique, it has been found desirable to effect complete condensation of the exhausting steam to reduce system pressure.

While the prior art methods discussed above are partially effective for cleaning of steam lines, they suffer from several drawbacks such as (1) excessive noise from the exhausting steam, (2) excessive requirements for steam in the cleaning, (3) disposal problems related to chemical usage or massive quantities of condensing water, (4) requirements for numerous exhaust blows to either build steam pressure or target changeout, (5) uncertainty related to the absolute degree of cleanliness obtained, (6) the time-consuming and expensive requirement to anchor the piping being cleaned to withstand reaction forces.

SUMMARY OF THE INVENTION

It is therefore an object of the present invention to provide an improved method for cleaning of pipes, conduits and the like using a high velocity gas stream.

Still a further object of the present invention is to provide a method for steam cleaning of pipes, conduits and the like which utilizes minimal amounts of steam, water and air.

Another object of the present invention is to provide an apparatus for exhausting high velocity gas from conduits which eliminates excessive noise.

Yet a further object of the present invention is to provide a method for exhausting high velocity steam from a conduit with minimal noise, force reaction level, or environmental disruption.

The above and other objects of the present invention will become apparent from the drawings, the description given herein, and the appended claims.

In one embodiment, the present invention provides a method of removing deposits from the internal walls of a conduit such as a steam line wherein a gas, preferably steam, is flowed through the conduit under conditions, e.g. high velocity, generating cavitation on the internal walls of the conduit, the cavitation being sufficient to dislodge deposits from the walls. The high velocity gas exhausting from the conduit is expanded, e.g. through an expander duct, while simultaneously a dispersion of a decelerating fluid such as a water mist is injected into the exhausting gas which is being expanded.

In another embodiment, the present invention provides a method of exhausting high velocity gas from a conduit in which the exhausting gas is expanded while simultaneously a dispersion of a decelerating fluid, preferably a liquid, such as a water mist, is injected into the expanding gas.

In yet still another embodiment, the present invention provides an exhaust apparatus for venting high velocity gases from a conduit such as a steam line being cleaned, the apparatus including an expander means connected to the conduit for expanding the high velocity gas issuing from the conduit and an injection means for injecting a dispersion of a decelerating fluid such as a water mist into the expanding gas in the expander means.

BRIEF DESCRIPTION OF THE DRAWINGS

The invention is best understood with reference to the drawings wherein like reference numerals refer to like parts and wherein.

DESCRIPTION OF THE PREFERRED EMBODIMENT

The present invention is based on the finding that scale or other solid deposits adhering to the interior of conduits can be quickly and efficiently removed using a gas blowdown method if flow conditions of the gas are controlled so as to generate cavitation on the interior walls of the conduits sufficient to effect erosion or break up of wall deposits and dislodgement of solids in cracks, recesses, etc. Cavitation of a gas occurs at conditions approaching full turbulence. However, to reach this condition much higher gas velocities are required in the conduit than have been previously used to effect gas blowdown cleaning. Moreover, the increased gas velocities necessary to effect full turbulence and cavitation at wall surfaces cannot ordinarily be accomplished because of the generation of sonic compression waves at the exhaust of the conduit being cleaned or any temporary piping connected to the conduit. It has now been found that generation of sonic compression waves can be virtually eliminated if the exhausting gas is expanded, and simultaneously, a decelerating fluid, such as water, is injected, as by spraying, into the flowing gas as it is expanding. For example, in the case of a high velocity steam stream, as the lower velocity droplets of the cooler, decelerating fluid, i.e. water, are accelerated by the higher velocity, expanding steam, the temperature, specific volume and velocity of the hotter exhausting steam is reduced avoiding sonic velocity, formation of compression waves, attendant pressure drop and noise normally encountered by such rapid expansion as high velocity steam exhausts from a conduit. In addition, the water droplets act as sound absorbers further attenuating the noise.

While the present invention will be described with reference to exhausting of or cleaning by high velocity steam, it is to be understood that it is applicable to other high velocity gas streams such as nitrogen, air, etc.

Figure 1:
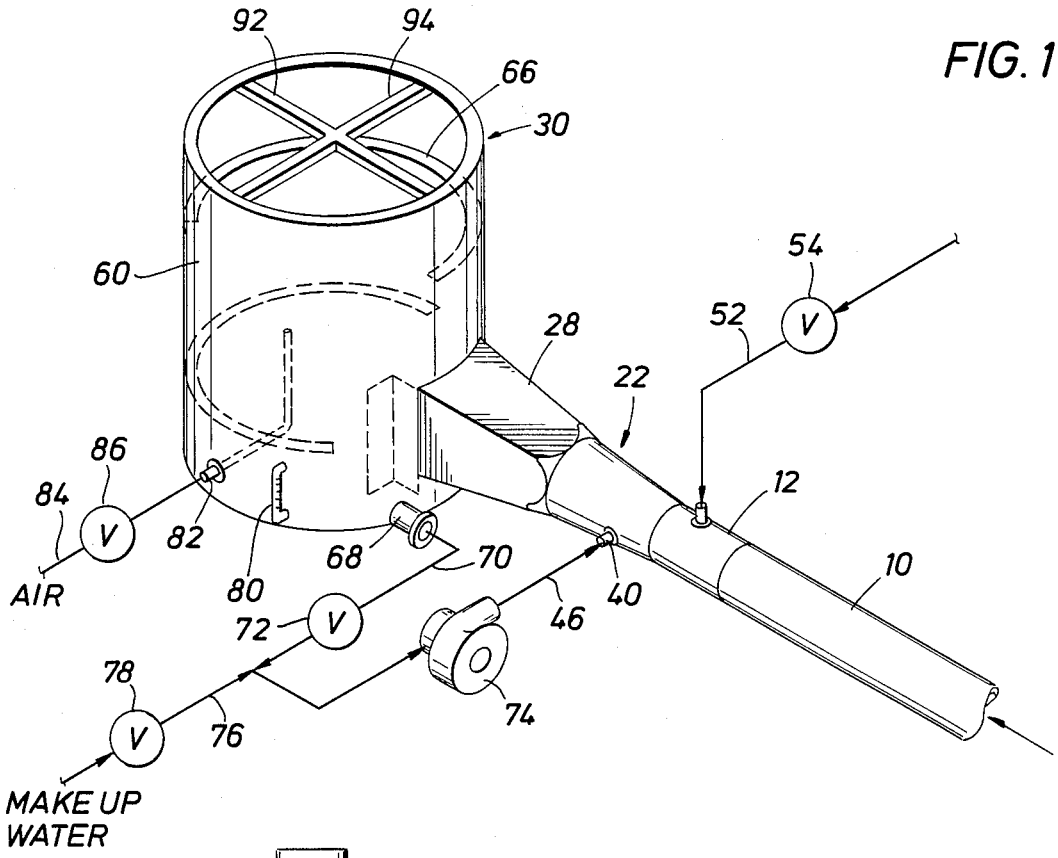
FIG. 1 is a perspective view of one embodiment of the exhaust apparatus of the present invention.
Figure 2:
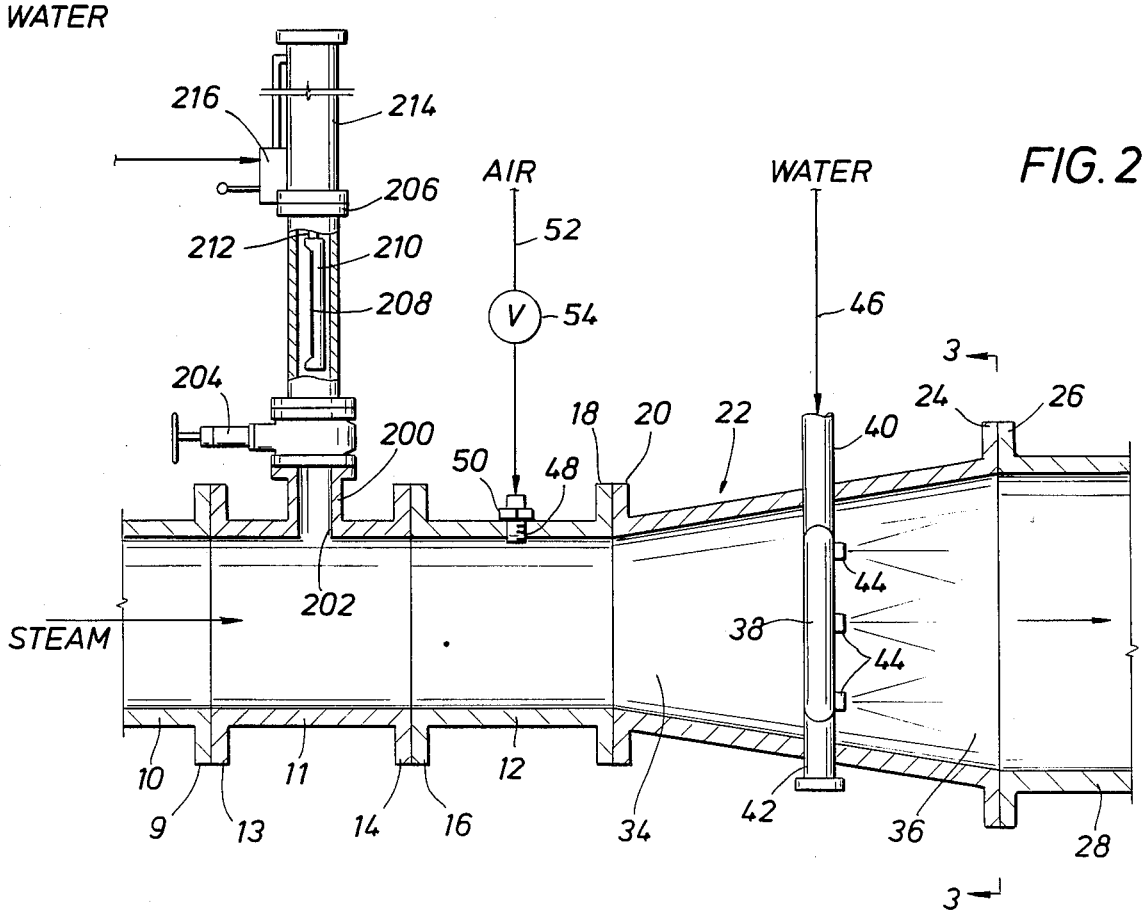
FIG. 2 is an elevational, cross-sectional view of the exhaust apparatus of the present invention showing the target changeout assembly.
Figure 4:
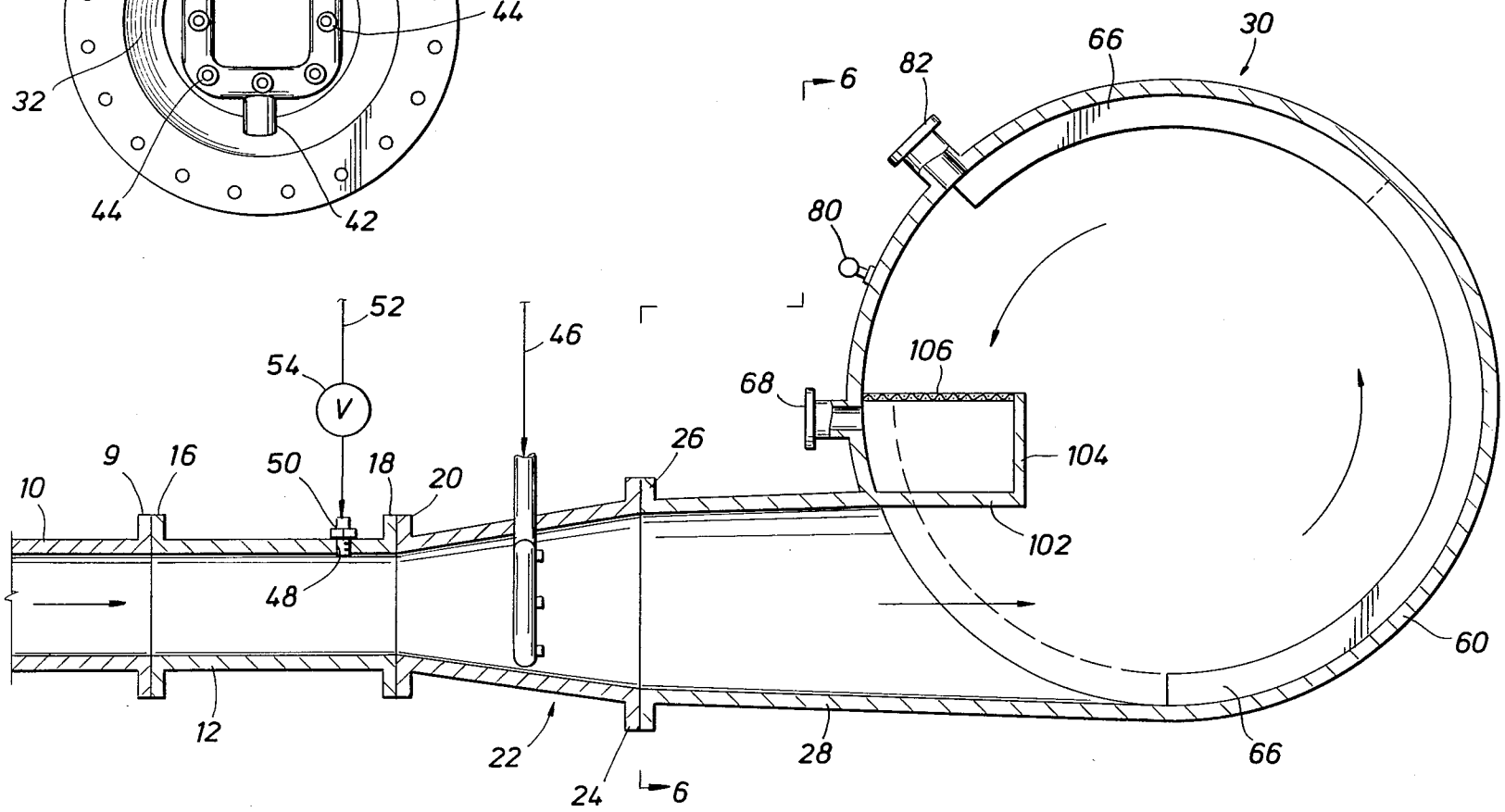
FIG. 4 is a top, cross-sectional view of the exhaust apparatus shown in FIG. 1.
Figure 3:
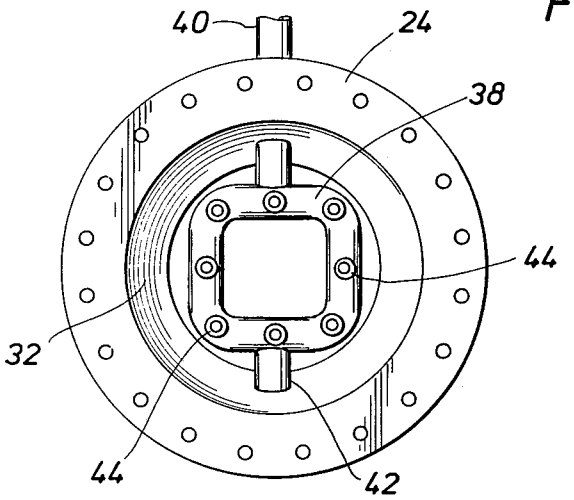
FIG. 3 is a view taken along the lines 3—3 of FIG. 2.

Referring now to FIGS. 1 and 2, a conduit 10 to be cleaned is connected, in conventional fashion to a spool 11 by means of pipe flange connections 9 and 13, respectively. Spool 11 is in turn connected by conventional type pipe flanges 14 and 16 to a second spool 12. Spool 12 is connected by flanges 18 and 20 to an expansion duct 22. Expansion duct 22 is in turn connected by pipe flanges 24 and 26 to the inlet 28 of a separator 30 (FIG. 1). Expansion duct 22 defines a generally frustoconical wall 32. Thus, expansion duct 22 has a gradually increasing diameter extending from a smaller throat section 34 to a larger mouth section 36. The frustoconical wall 32 defines a frustonical surface which has an angle of from about 5° to about 45°, preferably from about 15° to about 30°. Disposed interiorly of expansion duct 22 is a manifold 38 (see FIG. 3) formed of a generally rectangular tube. Manifold 38 is mounted in expansion duct 22 by means of an inlet pipe 40 and a blind pipe 42 which are attached to opposite sides of manifold 38 and extend through the wall 32 of expander duct 22. Mounted in manifold 38 are a series of nozzles 44, nozzles 44 being generally disposed about the periphery of manifold 38. Pipe 40 is connected to a source (not shown) of a suitable fluid such as water, the fluid being admitted to pipe 40 via line 46. Spool 12 has a tapped opening 48 in which is received a threaded injector nozzle 50, injection nozzle 50 being connected to a source (not shown) of a non-condensable gas such as air, the gas being introduced through injection nozzle 50 by means of line 52 and valve 54.

In operation, steam at high velocities exits conduit 10, passes through spool 11, and enters spool 12. As the steam passes through spool 12, air or some other suitable gas is introduced via injection nozzle 50. The combined air/steam mixture, still with undiminished velocity, enters the throat 34 of expander duct 22 at which point the steam commences expanding. As the expanding steam moves through expander duct 22, a dispersion of water or other suitable decelerating fluid is introduced as a mist or atomized into the expanding steam by means of nozzles 44 on manifold 38. Such introduction of decelerating fluid causes deceleration of the velocity of the steam to about 10% to about 20% of sonic velocity. While the decelerating fluid is shown as being introduced in the direction of flow of the steam, such is not necessary, the decelerating fluid can be introduced in a direction opposite to flowing steam, tangentially to the flowing steam, etc. The interaction of the slower moving water droplets and the higher moving steam results in a deceleration of the steam thus avoiding creation of a sonic compression wave which normally occurs when such high velocity steam is suddenly expanded. Accordingly, the steam exiting expansion duct 22 is decelerated to the point to eliminate any sonic compression wave with attendent noise generation. Such deceleration reduces the velocity to the range of from about 10% to about 20% of sonic velocity. The velocity of steam flowing through conduit 10 is sustained higher than the maximum velocity attainable during conventional blow down procedures because such flow is not restricted by a sonic compression wave. The velocity of steam flow in the conduit 10 is in the range of at least 40% of sonic velocity but less than about 85% of sonic velocity, thus developing greater cleaning activity in conduit 10 as compared to that attainable during conventional steam blow procedures. Also the steam in conduit 10 will have a ratio of inertial force to viscous force greater than $1.5\times10^5$ for enhancement of line cleaning. While in the embodiment shown in FIG. 2, the expansion duct 22 is shown as being connected to the inlet 28 of a separator 30, such is not necessary. In cases where it is not desired to recycle the water removed from the steam/water mixture exiting expansion duct 22 and where no environmental problems are posed, the flow from expansion duct 22 can simply be vented to the atmosphere. Introduction of a non-condensable gas such as air between conduit 10 and the expansion duct 22 is optional but desirable since it obviates the possibility of complete steam condensation in the expanded duct 22 which could cause steam hammer damage to upstream equipment. It is a significant feature of the present invention that the exhaust apparatus comprised of expander duct 22 and injection manifold 38 can be used as a silencer or muffler to prevent noise pollution caused by venting of high velocity gas, e.g. steam, from a conduit. In this regard, it needs to be observed that there are many instances, not involving steam cleaning of conduits or pipes, where a high velocity stream of steam must be vented, while keeping noise levels to a minimum.

In steam cleaning operations, and as discussed in the General Electric article cited above, the traditional method of determining the effectiveness of the steam cleaning is to dispose a target in the path of the exiting steam to determine if there are any solid particles entrained in the steam. Solid impingement on the target indicates the presence of debris in the lines being cleaned and the necessity for further cleaning. Referring then to FIG. 2, spool 11 has a neck portion 200 provided with a passageway 202 which opens into the interior of spool 11. Mounted on neck 200 is a slide valve 204. A target housing 206 is secured to slide valve 204, target housing 206 containing a target member 208. Conventionally, target members are comprised of soft metals, such as brass, copper or certain ceramic materials, all of which have highly polished surfaces which are easily marred by solids moving at high velocity and impinging on the surfaces. Target 208 is carried by a target mount 210 which in turn is connected to an actuator rod 212 extending from an actuator 214 mounted on housing 206. Actuator 214 is of the conventional double acting piston-cylinder type which is operated pneumatically by an air supply 216. Movement of the piston (not shown) in actuator 214 affects movement of rod 212 into and out of actuator 214. Accordingly, when slide valve 204 is in the open position such that bore 202 is in open communication with the interior of housing 206, and upon proper operation of actuator 214, actuator rod 212 will move target mount 210 and hence target 208 through slide valve 204, bore 202 and into the interior of spool 11, placing target 210 in the flowing steam path. Although not shown, housing 206 has a removable hatch cover by which target 210 can be accessed and changed as necessary. When the hatch cover of the housing 206 is in place, and slide valve 204 is open, there is open communication between the interior of the housing 206 and the interior of spool 11. However, because housing 206 is sealed to ambient, steam cannot escape through the housing 206. Provision can be made to introduce a cooling purge through housing 206 to cool target 208 for handling when valve 204 is closed. Accordingly, by using the target changeout assembly described above, the target can be inserted into the flowing steam path by a "hot tap" method eliminating the necessity to disassemble piping or shut down steam flow for target changeout, a time-consuming and costly process. Although not shown in the embodiments depicted in the other figures, for purposes of simplicity, it will appreciated that the target changeout assembly can be placed in any system when steam cleaning is being conducted and it is necessary to determine the effectiveness of the cleaning.

Referring now to FIGS. 1, 4, 6 and 7, the steam passes from expansion duct 22 into the inlet 28 of separator 30. Separator 30 comprises a generally cylindrical housing wall 60 having an upwardly facing open end 62 and a downwardly facing closed end wall 64. Inlet 28 which is generally in the shape of a horn is attached to cylindrical wall 60 so as to introduce steam entering separator 30 generally tangentially to the inner surface of cylindrical wall 60 (see in particular FIG. 4). As the steam flows upwardly in a spiral path against the inner surface of cylindrical wall 60, the steam and any liquids entrained therein contact radially inwardly extending baffles 66 which are secured to the inner surface of cylindrical wall 60 and which serve to aid in disengaging any liquid entrained in the steam as it flows upwardly through the open end 62 of separator 30. The disengaged liquid, generally water, collects on the bottom of container 30 and is recycled via outlet 68 passing through line 70 and valve 72 where it is injected by means of pump 74 and line 46, into manifold 38. Separator 30 also serves to collect large particles which might be expelled at high velocities as projectiles. Make up water, as needed, is introduced into line 70 via line 76 and valve 78.

A sight glass 80 permits the operator to determine the liquid level in separator 30. In order to disperse pluming of steam issuing through the open end 62 in separator 30, air is introduced into separator 30 via inlet 82 through line 84 and valve 86.

Figure 5:
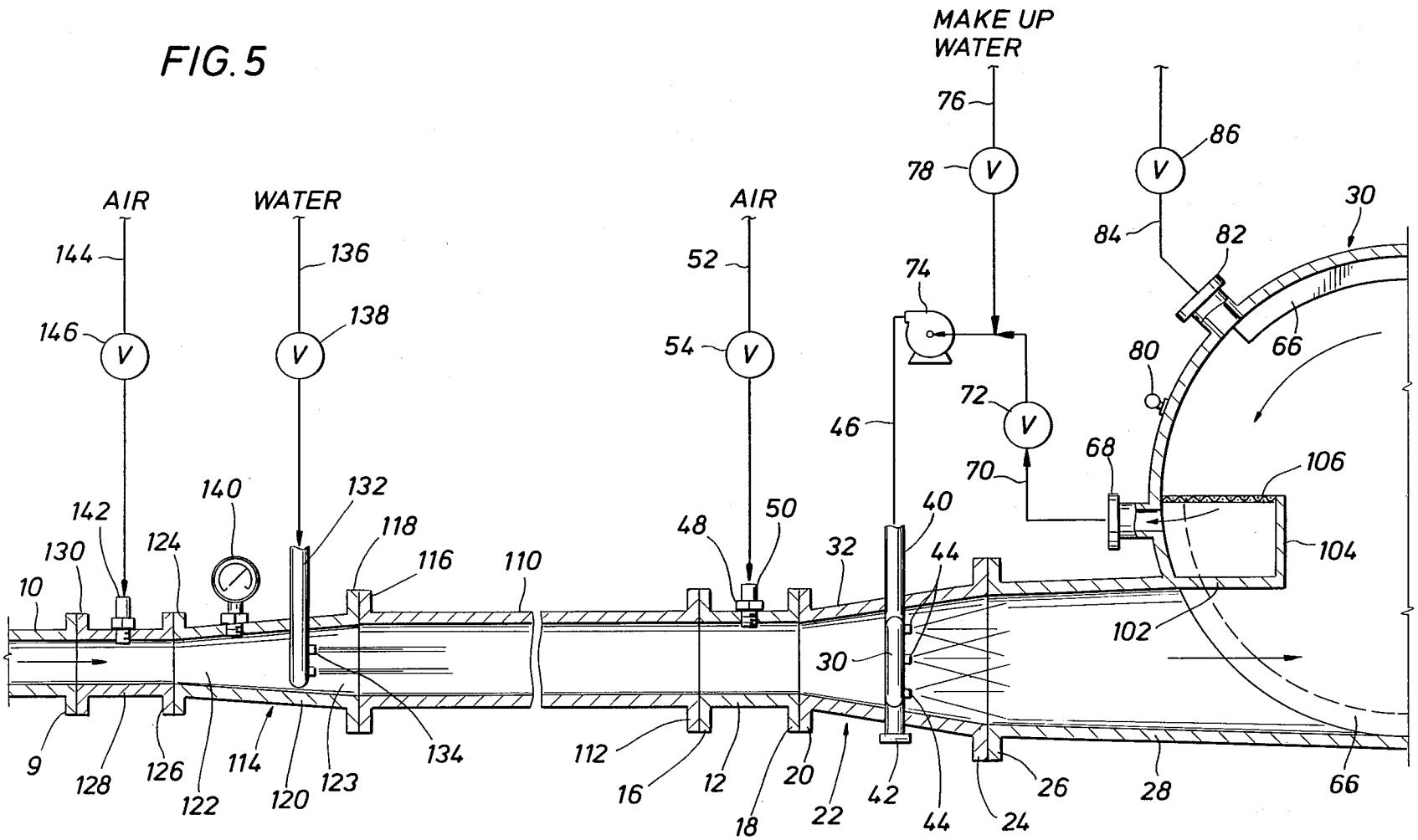
FIG. 5 is a view, similar to FIG. 4, showing another embodiment of the exhaust apparatus of the present invention.
Figure 7:
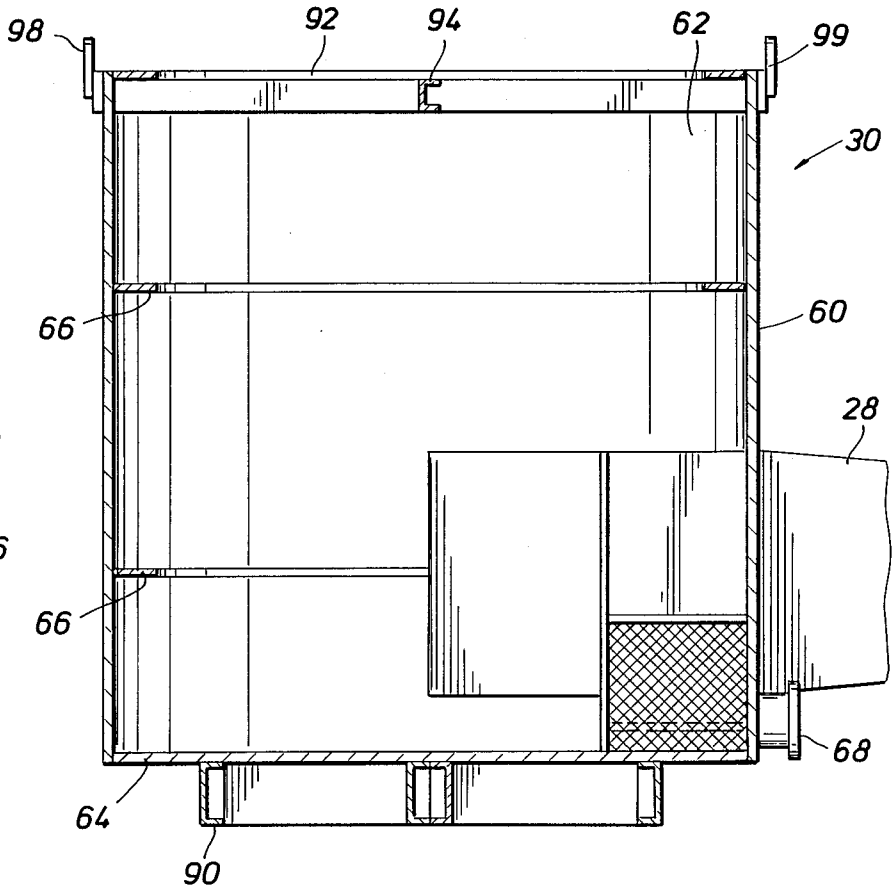
FIG. 7 is an elevational, cross-sectional view along the lines 7—7 of FIG. 6.
Figure 6:
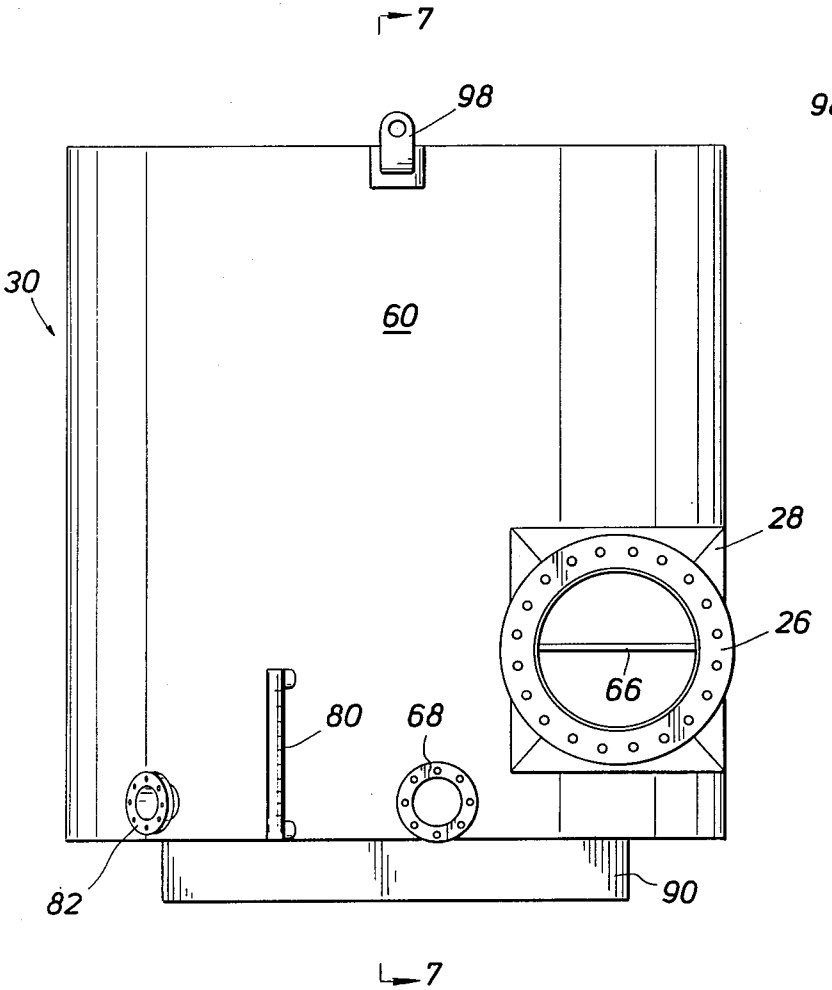
FIG. 6 is an elevational view of the separator used with the exhaust apparatus of the present invention.

FIGS. 5 and 6 show separator 30 in greater detail. Bottom wall 64 is secured to a base 90. Cross braces 92 and 94 support the upper end of the cylindrical wall 60 and span the open end 62 of separator 30. Lifting ears 98 and 99 provide a means whereby separator 30 can be easily lifted for transport from one location to the other. Liquid level in separator 30 collects in a sump formed by wall 102, wall 104 and screened wall 106. Screened wall 106 prevents any large solid particles from being drawn back in through pump 74.

In the embodiments discussed above, the exhaust apparatus is disposed closely adjacent the conduit being cleaned, i.e. conduit 10. As a practical matter, conduits that are being cleaned are often difficult to access. Accordingly, it is frequently necessary to install what is known as temporary piping to connect the permanent piping, i.e. conduit 10, to the exhaust apparatus. Referring then to FIG. 5, a section of temporary piping which can be referred to as a gas or steam transfer tube 110 is connected to spool 12 by means of flanges 16 and 112. The other end of steam transfer tube 110 is connected to a second expansion duct 114 by means of pipe flanges 116 and 118. Expansion duct 114 like expansion duct 22 has a generally frustoconical wall 120 defining a throat 122 and a larger mouth 123. However, the frustoconical surface formed by frustoconical wall 120 is generally at a shallower angle than that described above with respect to expanding duct 22. Thus, expander duct 114 provides a lesser degree of expansion of steam flowing therethrough than expander duct 22. The throat end 122 of expander duct 114 is connected by means of flanges 124 and 126 to a spool member 128 which in turn is connected to the permanent conduit 10 by means of pipe flanges 130 and 9. Received internally of duct 114 is a feed tube 132 provided with a plurality of nozzles or jets 134. Unlike nozzles 44 which are designed to introduce a dispersion of water or other such liquid in the form of a mist of fine droplets into expander duct 122, jets 134 are designed to eject a stream or jet of liquid rather than a dispersion. Water or other such liquids are supplied to feed tube 132 by means of line 136 and valve 138. Expander duct 114 is also provided with a pressure gauge 140 to determine steam pressure internally .of expander duct 114. For steam cleaning or exhausting, spool 128 is provided with an injector 142 for introducing air or other non-condensable gas into spool 128 via line 144 and valve 146.

In the cleaning of pipes by the steam blow down method of the present invention, and as noted above, it is necessary to maintain high steam velocity in the piping being cleaned, i.e. conduit 10. In order to minimize pressure drop in the temporary piping, i.e. steam transfer tube 110, steam exiting permanent conduit 10 is introduced into expanding duct 114 which, as noted above, is similar to expander duct 22, but which serves the purpose of desuperheating the exhausting steam from conduit 10 as well as allowing steam expansion without the buildup of a sonic compression wave. In this regard, it is to be observed that the pressure drop generated by saturated steam is less than the pressure drop generated by superheated steam. In order to effect saturation and rapid desuperheating of the steam as well as to prevent a sonic pressure wave, a fluid such as water is injected into the expanding steam internally of the expander duct 114, the liquid being ejected not in the form of a mist but in the form of a stream or jet, the effect being to saturate steam exhausting from conduit 11. To prevent massive condensation of steam in expansion duct 114, air or some other suitable non-condensable gas is introduced into the exhausting steam at some point between conduit 10 and expansion duct 14, i.e. prior to the steam being expanded. Water flow through jets 134 into expander duct 114 is adjusted to minimize back pressure in conduit 10. To this end, the pressure in expander duct 114 is monitored via pressure gauge 140 at a time when no water is being injected.

The desuperheating and decelerating fluid (water in this case) causes deceleration of the steam to a velocity between about 10% to about 20% of sonic velocity. The use of expander duct 114 and injected water to desuperheat the steam results in reducing the specific volume permitting the use of larger temporary piping, i.e. steam transfer tube 110, than could normally be used in conventional steam cleaning operations. This is advantageous as reducing the specific volume and the use of larger temporary piping allows back pressure to be minimized in conduit 10 which thereby aids in increasing steam velocity to obtain steam cavitation in conduit 10. Expansion and desuperheating of the steam according to this invention causes the steam velocity in the conduit 10 to be greater than 40% of sonic velocity.

In the cleaning method of the present invention, enhanced cleaning and removal of deposits from the interior surfaces of the pipes or conduits to be cleaned is enhanced by the use of rapid thermal cycling of the pipe walls coupled with the erosive effect obtained by adding a finely dispersed water spray into conduit 10 when steam velocities are such as to provide essentially full turbulence and therefore steam cavitation at the interior walls. In a typical example, the boiler supplying steam to the lines to be cleaned is fired at rates sufficient to generate velocities in excess of 300 feet per second in conduit 10. The steam generator or boiler is fired in such a manner as to generate steam of maximum temperature. Once the temperature in conduit 10 has reached a pre-determined maximum determined by the maximum temperature of steam obtainable, high purity water such as boiler feed water is injected into conduit 10 to effect rapid cooling of conduit 10 to near the saturation temperature of steam. Such injection of feed water for contacting the flowing steam changes velocity and temperature of the steam in the conduit 10. By repeating these steps in cyclical fashion, there is generated an erosive annular mist condition on the interior walls of the pipe which serves to scrub loosely adherent material from the pipe walls. It has also been found advantageous during this thermal cycling of conduit 10 and when the water spray is being introduced into conduit 10 to simultaneously inject a non-condensing gas such as nitrogen, air, etc. The introduction of non-condensable gas alters the equilibrium boiling point temperature of the steam which can lead to rapid boiling of the steam condensate in the annular film on the walls of conduit 10 during the thermal cycle stages of the process. This action disrupts the debris adhering to the surfaces of the pipe further enhancing the cleaning action.

Once thermal cycling of the permanent piping has been completed, the steam generator firing rate is increased to obtain maximum steam flows, temperatures and velocities in order to induce cavitation of the steam. Steam flow rates are regulated to produce maximum possible velocity in the line being cleaned. Where the steam source does not provide adequate steam flow to obtain full turbulent flow, the non-condensing gas, such as air or nitrogen, may be added to increase bulk velocities, generate full turbulent flow and set up cavitation. As noted, injection of such non-condensing gases can also be advantageously carried out during the thermal cycling of the piping as well. Cavitation during the cleaning operation is also aided by varying the steam flow rate which may be accomplished by cycling the flow of steam from the steam source or by intermittent injection of non-condensable gases at the inlet to conduit 10.

The addition of non-condensable gases in steam cleaning and exhausting is also useful in regulating the partial pressure of steam in the steam line being cleaned and thereby allows the use of steam to clean lines not designed for thermal expansion or adequately insulated to allow use of steam at temperatures above atmospheric saturation temperatures or the steam source temperatures.

In conducting the cleaning operation of the present invention, once magnetic and filter sampling of the condensate removed from the separator 30 indicates that no more particulate debris is being removed from the line, the target changeout assembly is employed. For example, in a typical cleaning operation the spool 11 carrying its target changeout apparatus described above would have been installed between tube 110 and spool 12. Once the target indicates no further entrainment of solid particles in the steam flow, the apparatus can be disassembled and the conduit 10 returned to permanent service.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An exhaust apparatus for venting high velocity steam, such apparatus connected to at least one outlet of a conduit system for carrying steam from a boiler to at least one remote location, such steam passing through the conduit system at near sonic velocities and causing cavitation at the internal wall surfaces of said conduit system comprising:

(a) first expander means having an inlet and an outlet;

(b) piping connected for fluid flow with at least one of said outlets of said conduit system and said inlet of said first expander means to direct passage of said stem from said boiler through said conduit system to said first expander means, said piping having a cross-sectional dimension at least equal to the cross-section dimension of said outlet of said conduit system;

(c) said inlet of said first expander means having a cross-sectional dimension at least equal to the cross sectional dimension of said outlet of said conduit system;

(d) said outlet of said first expander means having a cross-sectional dimension greater than the cross-sectional dimension of said inlet of said first expander means; and (e) first fluid injection means for injecting a dispersion of fluid into said first expander means to cool and decelerate said steam and to prevent creation of a sonic compression wave downstream of said outlet of said conduit system.

2. The apparatus of claim 1 further including target insert assembly means positoned on said piping upstream of said first expander means for selectively inserting and withdrawing a smooth target into and out of said gas passing through said piping.

3. The apparatus of claim 1 further including second injection means for a non-condensable gas into said steam between said outlet of said conduit system and first expander means.

4. The apparatus of claim 3 wherein said non-condensable gas is air.

5. The apparatus of claim 1 including separating means for separating entrained liquids and solids from said gas, said separator means having an inlet, the inlet of said separator means being connected to the outlet of said first expander means.

6. The apparatus of claim 5 wherein said separator means comprises a housing having an open end and a closed end, the inlet of said separator means being disposed adjacent said closed end.

7. The apparatus of claim 6 wherein said housing has a generally cylindrical wall having an interior surface, the inlet of said separator means being disposed so as to introduce gas generally tangentially onto the inner surface of said cylindrical wall.

8. The apparatus of claim 7 including partial circumferential radially inwardly extending baffles disposed on the interior surface of said cylindrical wall.

9. The apparatus of claim 1 wherein said first expander means defines a frustoconical surface.

10. The apparatus of claim 9 wherein said frustoconical surface has an angle of from about 5 to about 45 degrees.

11. The apparatus of claim 1 wherein said first injection means comprises at least one nozzle disposed in said first expander means.

12. The apparatus of claim 11 wherein there are a plurality of said nozzles.

13. An exhaust apparatus for venting high velocity steam, such apparatus connected to at least one outlet of a conduit system for carrying steam from a boiler to at least one remote location, such steam passing through the conduit system at near sonic velocities and causing cavitation at the internal wall surfaces of said conduit system comprising:

(a) first expander means having an inlet and an outlet;

(b) piping connected in open communication with an outlet of said conduit system and said inlet of said first expander means to allow passage of said steam from said boiler through said conduit system to said first expander means, said piping having a cross-sectional dimension at least equal to the cross-sectional dimension of said outlet of said conduit system;

(c) said inlet of said first expander means having a cross-sectional dimension at least equal to the cross-sectional dimension of said outlet of said conduit system;

(d) said outlet of said first expander means having a cross-sectional dimension greater than the cross-sectional dimension of said inlet of said first expander means;

(e) first fluid injection means for dispersing a fluid into said first expander means to cool and decelerate said steam and to prevent creation of a sonic compression wave downstream of said outlet of said conduit system;

(f) a gas transfer tube having an inlet and an outlet, said inlet of said gas transfer tube connected to and in open communication with said outlet of said first expander means to allow passage of said steam from said first expander means through said gas transfer tube, said tube having a cross sectional dimension at least equal to the cross-sectional dimension of said outlet of said first expander means;

(g) second expander means having an inlet and an outlet, said inlet of said second expander means connected to and in open communication with said outlet of said gas transfer tube to allow passage of said steam from said gas transfer tube through said second expander means; and (h) second fluid injection means for injecting a dispersion of fluid into said second injection means to cool and decelerate said steam and to prevent creation of a sonic compression wave downstream of said outlet of said conduit system.

14. The apparatus of claim 13 further including a pressure gauge positioned upstream of said first injection means to measure the pressure of said steam.

15. The apparatus of claim 14 wherein said first expander means defines a frusto-conical surface.

16. The apparatus of claim 15 including separating means for separating entrained liquids and solids from said steam, said separator means having an inlet, the inlet of said separator means being connected to the outlet of said second expander means.

17. The apparatus of claim 13 further including:

(a) first air injection means to inject air into said first expander means; and (b) second air injection means to inject air into said second expander means.

* * * * *